US005755611A

United States Patent [19]

Noble et al.

[11] Patent Number: 5,755,611

[45] Date of Patent: May 26, 1998

[54] SELF-SUPPORTING BREAST CUP

[76] Inventors: Cecil Noble, #1 Oakhill Park Mews, London NW3 7LH, England; Dora Noble, #1 Oakhill Park Mews, London NW3 7LH, England

[21] Appl. No.: 777,157

[22] Filed: Dec. 26, 1996

[51] Int. Cl.[6] ..... A41C 3/06

[52] U.S. Cl. ..... 450/39; 450/81; 450/40

[58] Field of Search ..... 2/73, 46, 48, 174, 2/67; 450/30, 31, 32, 37, 38, 53, 54, 55, 56, 57, 81, 39, 40

[56] References Cited

U.S. PATENT DOCUMENTS

| | | | |
|---|---|---|---|
| 2,079,426 | 5/1937 | Schottenfels | 450/81 |
| 2,292,024 | 8/1942 | Dreher | 450/81 |
| 2,633,440 | 3/1953 | Scholl | 450/81 |
| 2,728,079 | 12/1955 | Wiliams | 450/81 |
| 2,869,553 | 1/1959 | D'or | 450/81 |
| 3,070,870 | 1/1963 | Alexander et al. | 450/39 |
| 3,101,717 | 8/1963 | Korman | 450/39 |
| 3,202,565 | 8/1965 | Loftin | 450/39 |
| 3,221,748 | 12/1965 | Glasser | 450/53 |
| 3,266,495 | 8/1966 | Sachs | 450/55 |
| 3,280,818 | 10/1966 | Pankey et al. | 450/81 |
| 3,297,036 | 1/1967 | Williams | 450/81 |
| 3,434,478 | 3/1969 | Liebowitz et al | 450/39 |
| 3,574,520 | 4/1971 | Aldrich | 450/39 |
| 3,749,102 | 7/1973 | Wynants | 450/81 |
| 3,934,593 | 1/1976 | Mellinger | 450/81 |
| 4,172,002 | 10/1979 | Gluckin | 450/39 |
| 4,343,313 | 8/1982 | Le Jeune | 450/81 |
| 4,372,321 | 2/1983 | Robinson | 450/39 |
| 4,572,195 | 2/1986 | Hyams | 450/39 |
| 4,640,288 | 2/1987 | Hattori | 450/81 |
| 4,701,964 | 10/1987 | Bell et al. | 450/40 |
| 4,992,074 | 2/1991 | Diaz | 450/57 |
| 5,154,659 | 10/1992 | Gluckin | 450/39 |
| 5,447,462 | 9/1995 | Smith et al. | 450/39 |

FOREIGN PATENT DOCUMENTS

| | | | |
|---|---|---|---|
| A076359 | 8/1961 | France | 450/39 |
| 2505620 | 11/1982 | France | 450/81 |

OTHER PUBLICATIONS

Item #1 "Sensational NO BRA" UK Dailey Express/Daily Mirror, Feb. 1985

Item #2 "NO NO BRA" UK Dailey Express/Dailey Mirror, Feb. 1985.

Item #3 "Staykups" (Product literature) 1981.

Item #2 "BH HAFTSCHALEN" Tina Versandhaus Mail Order Catalogue Germany, Feb. 1985.

Item #3 "NO NO BRA" Catalogue of Magnamail Pty, Australia, Feb. 1985.

*Primary Examiner*—Jeanette E. Chapman

*Attorney, Agent, or Firm*—Caesar, Rivise, Bernstein Cohen & Pokotilow, Ltd.

[57] ABSTRACT

A breast support device including a soft, natural breast-shape cup portion for receiving a portion of the breast and a flat, peripheral flange portion which may be secured to the body of the wearer immediately beneath the breast by adhesive tape and renewer adhesive to permit the device to be worn repeatedly.

11 Claims, 7 Drawing Sheets

FIG. 4
PRIOR ART
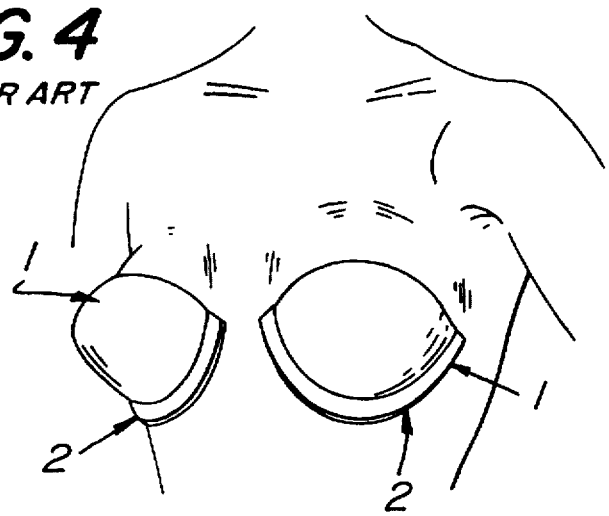
FIG. 5
PRIOR ART
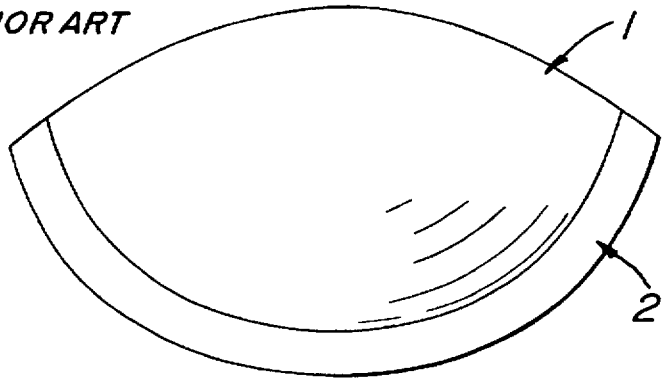
FIG. 8
PRIOR ART
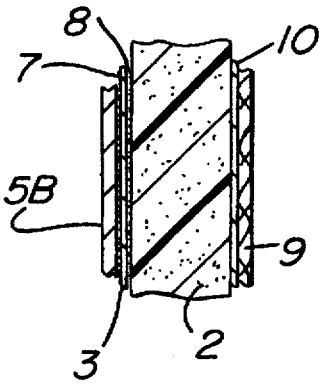
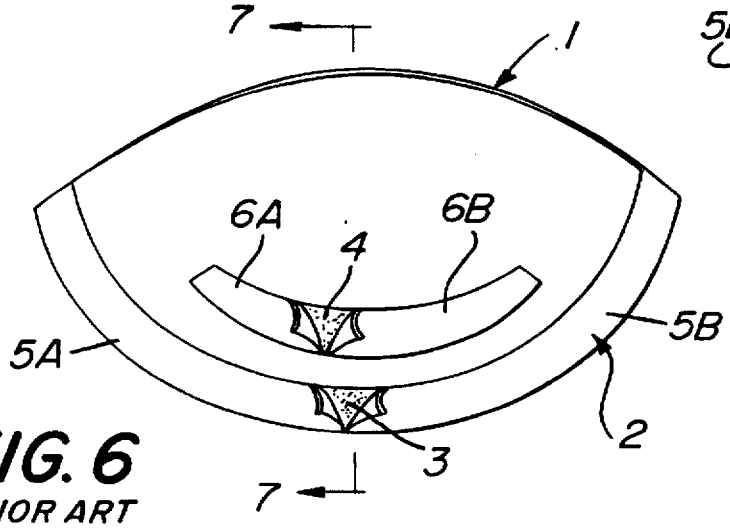
FIG. 6
PRIOR ART FIG. 9
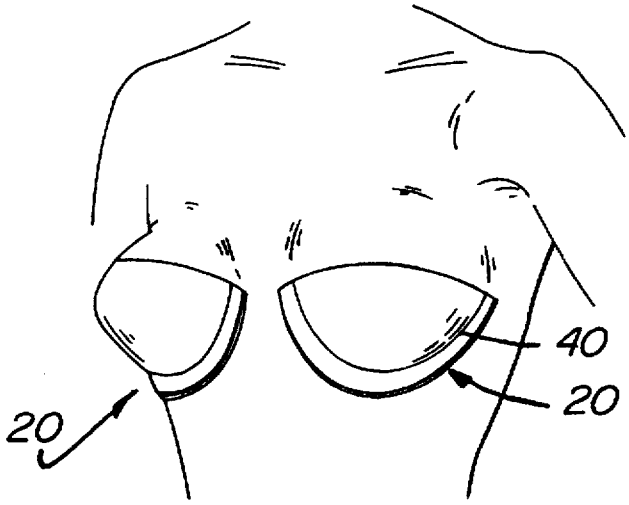
FIG. 10
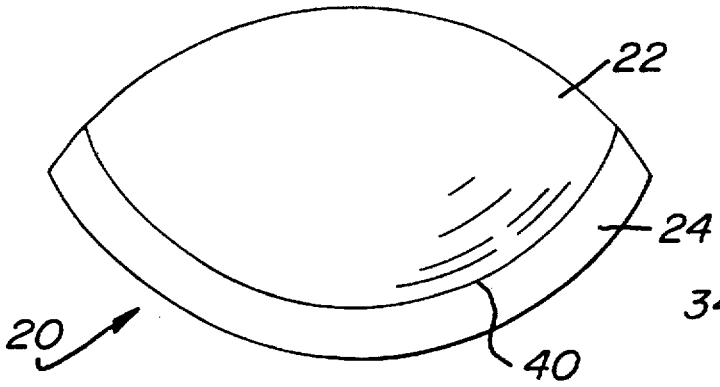
FIG. 13
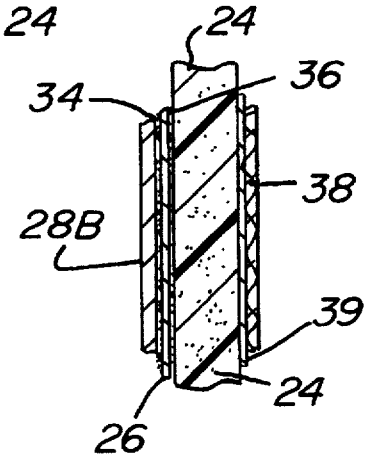
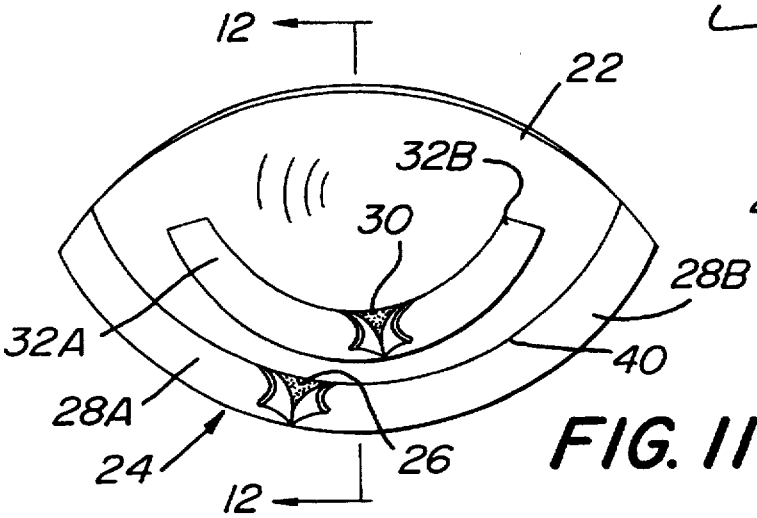
FIG. 11

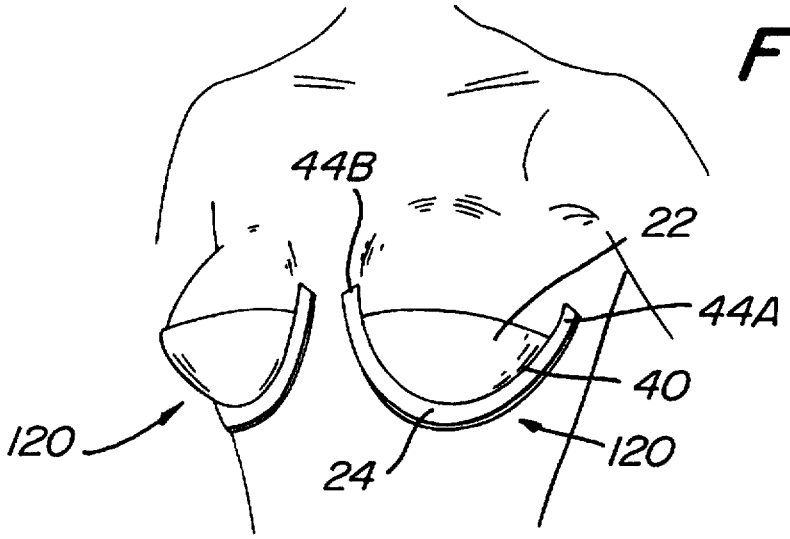
FIG. 14
FIG. 15
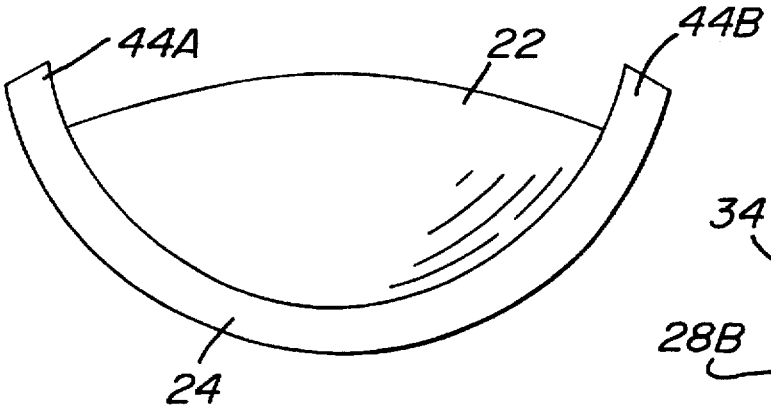
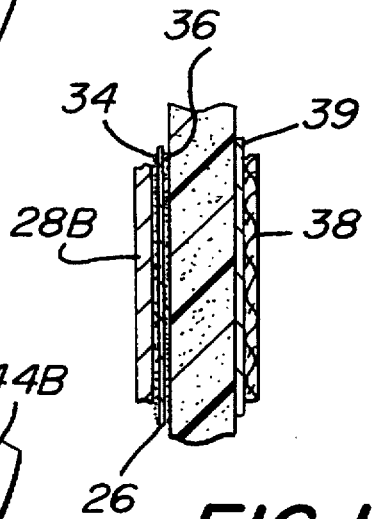
FIG. 17
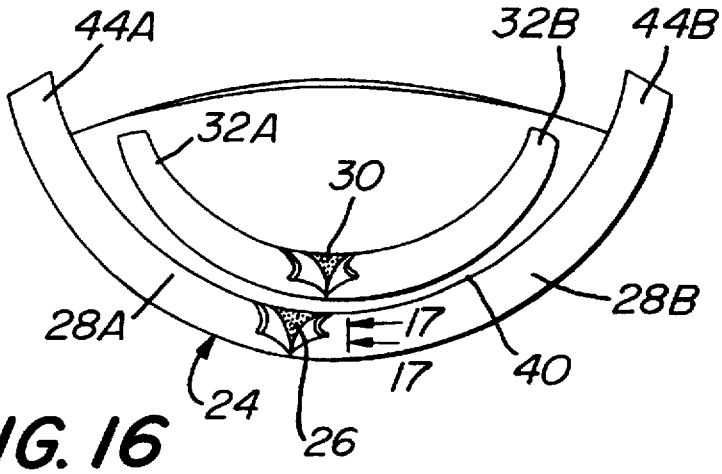
FIG. 16

FIG. 18
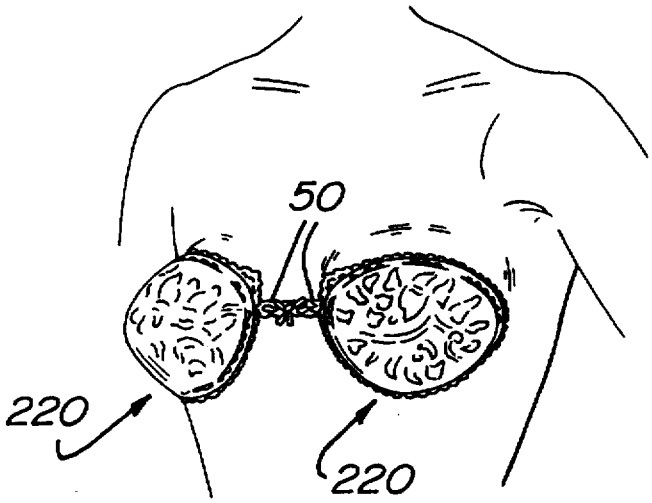
FIG. 19
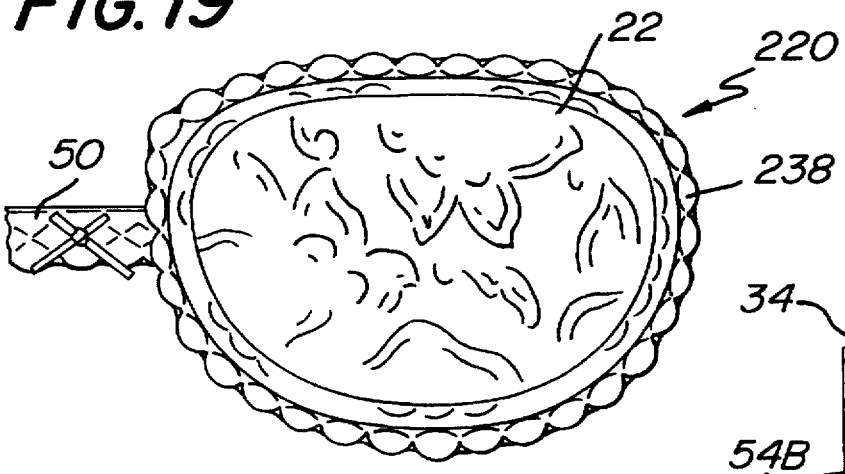
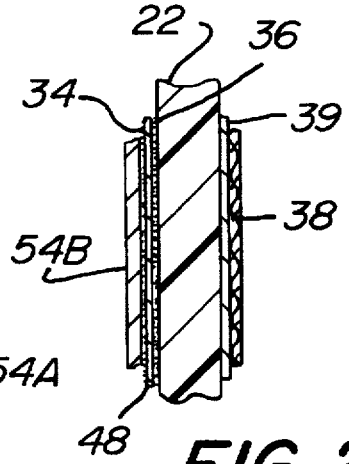
FIG. 21
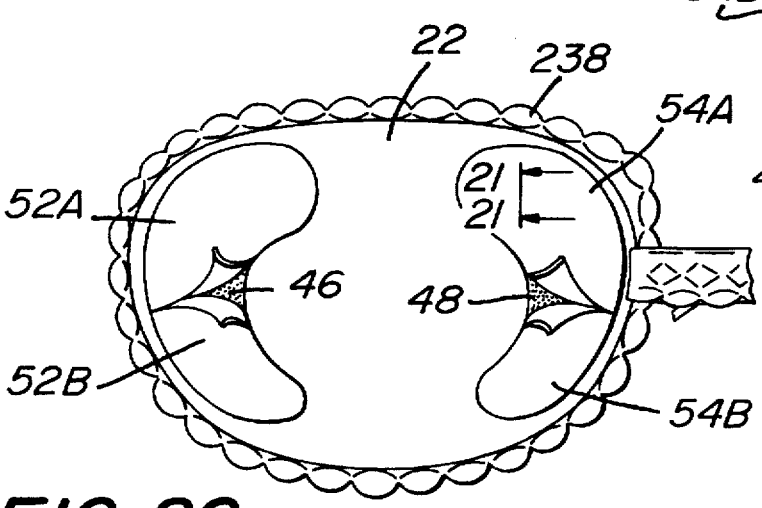
FIG. 20

SELF-SUPPORTING BREAST CUP

SPECIFICATION

1. Field of the Invention

This invention relates generally to the field of women's underclothing, more particularly, to brassieres requiring no straps or hooks.

2. Background of the Invention

Many types of brassieres are available to women that provide the necessary bust support and/or appearance. However, standard brassieres require the use of hooks and straps to secure the breast cups in the proper position for the desired support and/or appearance. Not only may these hooks and straps be uncomfortable for some women, but in addition, they cannot be worn with certain apparel such as off-the-shoulder dresses, plunging back or front gowns, etc. In addition, the hooks or straps, or even other portions of these brassieres, may cause bulging or protuberances that take away from the smooth contour of the woman's torso when a blouse, dress or gown is worn. A further obstacle of a normal strap/hook brassiere worn with a plunge-line backless dress is the unsightly appearance of the back straps of the brassiere causing a hideous distraction to a beautifully fashioned backless dress.

To overcome these problems, Marvelle Bras (London) Ltd., T/A Elda Originals, sells self-supporting brassiere cups known as "Staykups™". As shown most clearly in FIGS. 1–8, the Staykup™ comprises a breast cup portion 1 having a flattened peripheral portion 2 underneath and along the sides of the cup portion 1. The breast cup portion 1 covers the full breast. On the back side of the flattened peripheral flange 2, as shown most clearly in FIGS. 6 and 7, is a double-sided tape strip 3 covered with release sheets 5A–5B. On the inside surface of the breast cup portion 2 is another double-sided tape strip 4 covered with release sheets 6A and 6B. These two adhesive tape strips 3 and 4 provide the releasable securing means for securing the Staykup™ underneath the wearer's breast and to the lower portion of the wearer's breast, as shown in FIGS. 2–3, without the need for any hooks or straps. As shown most clearly in FIG. 8, the film strip 3 has a first adhesive layer 7 to which the release sheets 5A–5B (and, ultimately, to the wearer's body) are releasably secured; a second adhesive layer 8 secures the strip 3 to the peripheral flange portion 2. The material covering the exterior of the Staykup™, both the breast cup portion 1 and the flattened peripheral flange 2, is a coarse polyester covering material 9. The color of the covering material 9 may be a skintone color, or black or white color.

The breast cup portion 1 and the flattened peripheral flange 2 comprise a hard foam quality LD (low density) #60, supplied by Plasmar Limited of England. The hard foam quality LD #60 (forming both the breast cup portion 1 and the flattened peripheral flange 2) and the coarse covering material 9 are laminated into sheets, using a rigid adhesive film 10 disposed between them (FIG. 8). The laminated sheets are cut into 2-sized strips (known as blanks): 8½"× 12" for cup sizes A, B or C and 12"×12" for cup size D.

To permit the Staykup™ to be reused several times, a bottle of adhesive with a brush (not shown) is supplied in order to allow the wearer to apply a thin coat of adhesive on the flange, thereby restoring the adhesive quality of the strips 3 and 4 for reapplication of the Staykups™ to the wearer's body.

However, the Staykup™ is a very hard cup that covers the full breast. It does not have the feel of a natural breast or skin and it does not accommodate today's plunge-line fashions. In addition, the Staykup™ is manually cut from the molded sheets, thereby diminishing its smooth appearance as well as hindering the production of matching cups on a consistent basis.

Thus, there remains a need for a self-supporting breast cup that is pre-formed in the shape of different breast sizes (including left and right) and provides the requisite support for the breast without using hooks and straps, that can be reused several times, that is comfortable to wear, that has a soft natural shape, that can accommodate today's plunge-line fashions, that feels like skin and that does not disturb the contour of the woman's torso with unwanted protuberances, thereby providing a natural yet supportive appearance to a woman's bust.

OBJECTS OF THE INVENTION

Accordingly, it is the general object of this invention to provide an apparatus which addresses the aforementioned needs.

It is a further object of this invention to provide a brassiere that eliminates the need for straps or hooks.

It is yet another object of this invention to provide a brassiere that enhances the wearing of strapless, backless dresses.

It is even a further object of this invention to provide a brassiere that provides a soft natural shape to a woman's bust.

It is still yet a further object of this invention to provide a brassiere that feels like skin.

It is still yet a further object of this invention to provide a brassiere that gives a natural contour to an undersized breast.

SUMMARY OF THE INVENTION

These and other objects of the instant invention are achieved by providing a reusable breast support apparatus which comprises a soft, skin-like cup portion that is adapted to receive a portion of the breast and wherein the soft, skin-like cup portion is preformed in the shape of the portion of the breast to support the breast while covering the nipple. In addition, the reusable breast support apparatus comprises a flattened peripheral flange portion extending about part of the periphery of the cup portion and is joined thereto at a fold line. Furthermore, the breast apparatus comprises means for releasably securing the apparatus under the breast to the body independent of any coupling to other body parts. The releasable securing means forms a first adhesive layer on one side of the flattened peripheral flange portion and whereby the first adhesive layer adheres to the body underneath the breast when the one side of the flattened peripheral flange portion is pressed against the body.

DESCRIPTION OF THE DRAWINGS

Other objects and many of the attendant advantages of this invention will be readily appreciated as the same becomes better understood by reference to the following detailed description when considered in connection with the accompanying drawings wherein:

FIG. 4 depicts the prior art self supporting brassiere cups as they are worn around the breasts in regard to FIGS. 5–8;

FIG. 5 is a front elevation view of the prior art self supporting brassiere cup;

FIG. 6 is a back elevation view of the prior art self supporting brassiere cup;

FIG. 8 is an enlarged view taken of the circled portion in FIG. 7;

FIG. 9 depicts the present invention being worn around the breasts;

FIG. 10 is a front elevation view of the present invention;

FIG. 11 is a back elevation view of the present invention;

FIG. 13 is an enlarged view taken of the circled portion in FIG. 12;

FIG. 14 depicts a second embodiment of the present invention being worn around the breasts;

FIG. 15 is a front elevation view of the second embodiment of the present invention;

FIG. 16 is a back elevation view of the second embodiment of the present invention;

FIG. 17 is an enlarged view taken along line 17—17 of FIG. 16;

FIG. 18 depicts a third embodiment of the present invention being worn around the breasts;

FIG. 19 is a front elevation view of the third embodiment of the present invention;

FIG. 20 is a back elevation view of the third embodiment of the present invention;

FIG. 21 is an enlarged view taken along line 21—21 of FIG. 20; and

DESCRIPTION OF THE PREFERRED EMBODIMENT OF THE INVENTION

Figures 7, 12:
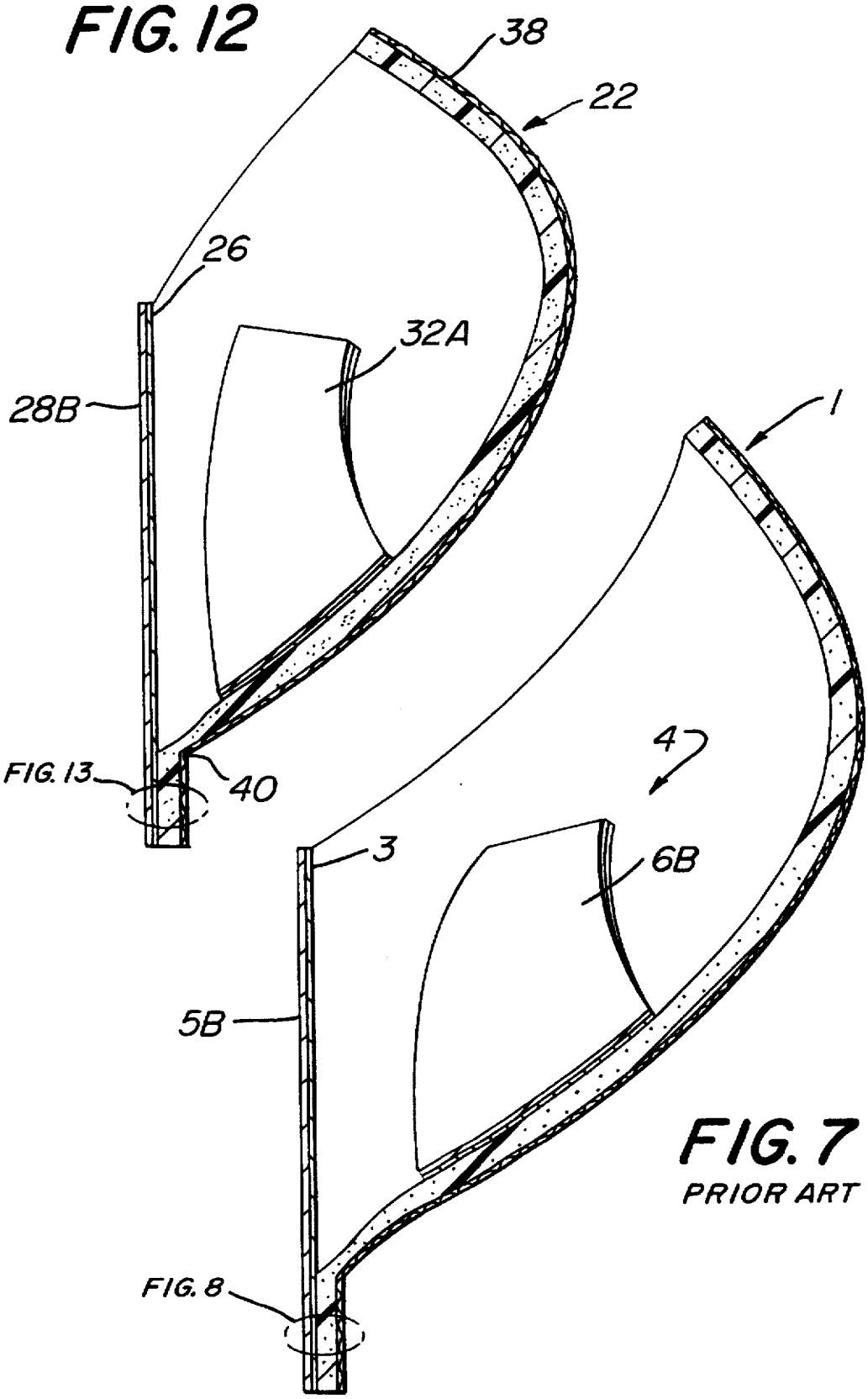
FIG. 7 PRIOR ART
FIG. 7 is an enlarged view taken along line 7—7 of FIG. 6.
FIG. 12 is an enlarged view taken along line 12—12 of FIG. 11.

Referring now in greater detail to the various figures of the drawing wherein like reference characters refer to like parts, an improved version of Staykup™, also known as Staykup II, constructed in accordance with the present invention is shown generally at 20 in FIG. 9. Staykup II, hereinafter known as the self-supporting breast cup (hereinafter "SSBC") 20 comprises a breast cup portion 22 and a flattened peripheral flange 24 underneath and along the sides of the cup portion 22. The breast cup portion 22 is a ¾ cup, thereby revealing the top part of the breast in wear. On the back side of the flattened peripheral flange 24, as shown most clearly in FIGS. 11 and 12, is a double-sided tape strip 26 covered with release sheets 28A and 28B. On the inside surface of the breast cup portion 22 is another double-sided tape strip 30 with release sheets 32A and 32B. These two adhesive tape strips 26 and 30 provide the releasable securing means for securing the SSBC 20 underneath the wearer's breast and to the lower portion of the wearer's breast without the need for any hooks or straps. As shown most clearly in FIG. 13, the tape strip 26 has a first adhesive layer 34 to which the release sheets 28A and 28B (and, ultimately, to the wearer's body) are releasably secured; a second adhesive layer 36 secures the tape strip 26 to the peripheral flange portion 24. The material covering the exterior of the SSBC 20, both the breast cup portion 22 and the peripheral flange portion 24, is a covering material 38 comprising a satin finish jersey Tricot or a poly material, which gives the SSBC 20 a natural soft skin-like texture.

The breast cup portion 22 (as shown in FIGS. 9–21) and the flattened peripheral flange 24 (as shown in FIGS. 9–17) comprise a soft foam quality LD (low density) #24, supplied by Plasmar Limited of England. The soft foam quality LD #24 (forming both the breast cup portion 22 and the flattened peripheral flange 24) and the covering material 38 are laminated with a stretch adhesive film 39 which improves the spread and total adhesion of the covering material 38 during lamination. In particular, the breast cup portion 22 and the flattened peripheral flange 24 are integrally formed by pressing under heat (at approximately 140° C.) a laminated sheet (e.g., 12½"×8½") comprising thin foamed plastics such as polyethylene sheet material (e.g., "Plastazote™" #24 kg/M3 supplied by Plasmar Limited of England; Plastazote is a low density closed cell, cross-linked polyethylene foam available in sheet form) and the covering material 38 (e.g., a knitted textile material) such as polyester, lace or satin bonded with a special adhesive film 39 (e.g., Adhesive Film V502-1-25 supplied by Cornelius Chemical Co. Ltd. of England) to one side of the foamed plastics sheet to form the outer side of the SSBC 20 . The breast cup portion 22 and the peripheral flange 24 are integrally joined at a fold line 40. Where the covering material 38 is a satin finish jersey Tricot or poly material, such material 38 gives the SSBC 20 a natural soft skin-like texture.

As stated earlier, the breast cup portion 22 of the SSBC 20 is molded into four cup sizes A, B, C and D shaped to receive the breast. As can be seen by comparing FIG. 4 (Staykup™) and FIG. 9 (SSBC 20), it is apparent that the ¾ cup of the SSBC 20 is smaller than the full cup Staykup™ and thus can accommodate today's popular plunge-line fashions while covering the nipple and while providing the same support as the Staykup™. In particular, with the SSBC 20 in place, the upper part of the woman's breast is revealed; in contradistinction, the upper portion of the Staykup™ would project upward beyond the bust line of the wearer's dress.

The bonded material of Plastazote and satin jersey (or polyester lace as is discussed below with regard to the third embodiment SSBC 220) is cut into blanks of 8½"12" for cup sizes A, B, and C and into blanks of 12"×12" for cup size D. As will be discussed in detail later, these blanks are then heated and placed flat onto a molding machine. They are then molded into the cups formed over the metal molds in sizes A, B, C and D cups, accordingly.

The double-sided adhesive tape strips 26 and 30 (e.g., #13254 Toupe Tape, 1975 clear, 381 mm×222 mm supplied by Advance Tapes of England; the tape is skin-friendly and is anti-allergic to normal skin) are secured to the peripheral flange 24 and to the inside the SSBC 20, respectively. The respective release sheets 28A/28B and 32A/32B are slit, as shown in FIG. 11 to facilitate removal.

In use, the release sheets 28A/28B and 32A/32B are removed and a thin coat of the renewer adhesive (e.g., #412211 adhesive supplied by Cripsin Chemical Co. Ltd. of England) is applied and allowed to dry for 20 minutes. The reason for applying a thin coat of the skin-friendly adhesive directly after removing the release sheets 28A/28B and 32A/32B is that this increases the hold of the cups, thus helping to eliminate any possible detachment from the wearer's body.

Figure 1:
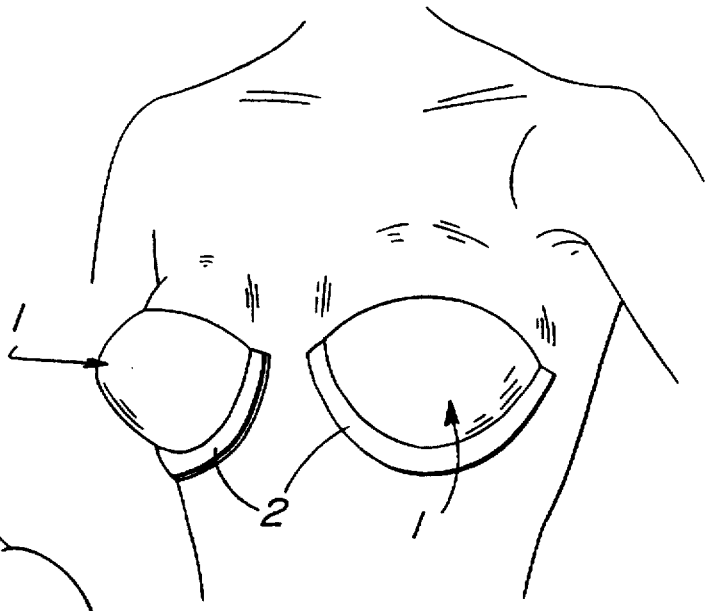
FIG. 1 PRIOR ART
FIG. 1 is depicts the prior art self supporting brassiere cups as they are worn around the breasts.
Figure 2:
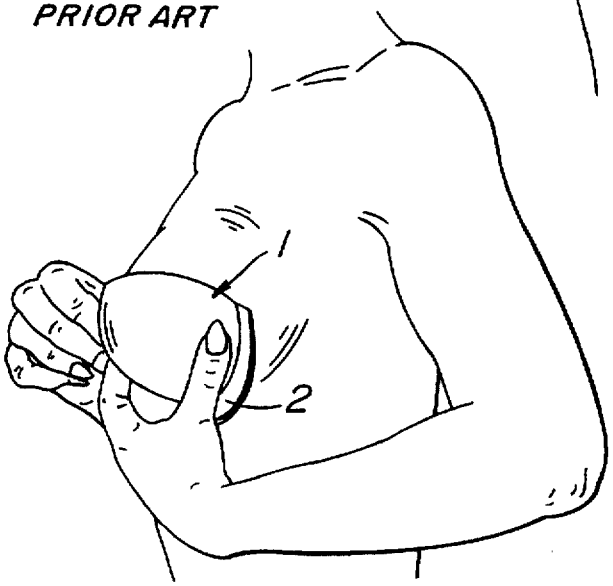
FIG. 2 PRIOR ART
FIG. 2 depicts one prior art self supporting brassiere cup being applied to a breast.
Figure 3:
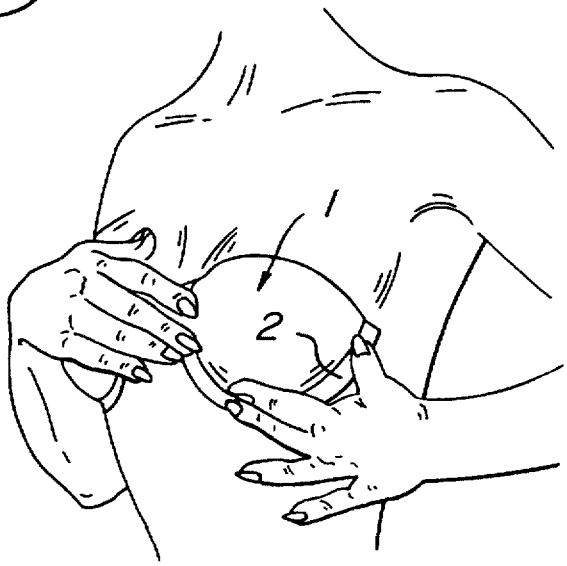
FIG. 3 PRIOR ART
FIG. 3 depicts the prior art self supporting brassiere cup of FIG. 2 being applied around the breast, with the adhesive on the peripheral flange being pressed against the wearer's body.

Application of the SSBC 20 to the wearer is similar to the procedure shown in FIGS. 2–3 for the Staykups™, described earlier. It should be understood that reference to FIGS. 2–3 with respect to the SSBC 20 is meant only to demonstrate how the SSBC 20 is applied to the wearer and is not meant, in any way, to identify the SSBC 20 with the Staykup™.

After the 20 minutes has passed, the fold line 40 is fitted to the curve of the breast, and the peripheral flange 24 is pressed to the body of the wearer (viz., FIG. 3, to the skin surfaces above the lateral, inferior and medial portions of the rib cage), and also the tape strip 30 is pressed to the breast (FIG. 2) to releasably secure the SSBC 20 to the wearer for properly supporting the breast.

It is essential that the skin-friendly renewer adhesive be applied to the tape strips 26 and 30; this may also be done when the tape strips have lost their adhesion, after one wearing and just before wearing for a second time. A small amount of liquid adhesive may be applied to the inwardly facing adhesive surface of the strips 26 and 30 for the purpose of re-activating, or applying a second coat of adhesive on the inwardly facing adhesive surfaces. Such application or re-activating may be repeated after further wearings.

Both the liquid adhesive and the adhesive on the inwardly facing adhesive surfaces of the strips 26 and 30 should not irritate sensitive skin nor cause any allergies. It is important the liquid adhesive be allowed to fully dry a minimum of 20 minutes prior to application.

It should be noted that a pair of SSBCs 20 may be worn in the orientation shown in FIG. 9, or may be at an angle such that each SSBC 20 is positioned near the wearer's armpit to give a "plunge" effect for wear with low-cut dresses and the like.

A second embodiment 120 of the SSBC is shown in FIGS. 14–16. The second embodiment 120 is a ½ cup, which reveals the top half of the breast in wear. The second embodiment 120 is similar in construction to the SSBC 20 except it is only a ½ cup and the peripheral flange 24 has extensions 44A and 44B (which also comprise extensions of the tape strip 26) that project beyond the breast cup portion 22. These extensions 44A and 44B may project approximately 10 centimeters beyond the breast cup portion 22. The shorter cup 22 of the SSBC 120 provides less covering of the breast, especially for a low neckline dress. The extensions 44A and 44B give total balanced support and compensate for the drag on the cup portion 22 from the increased pressure carried by the upper part of the breast pressing down against the top cup.

A third embodiment 220 of the SSBC is shown in FIGS. 18–21. The third embodiment 220 is a full cup that covers the entire breast and is designed especially for women with extremely close separation of the breasts. The third embodiment 220 is similar in construction to the SSBC 20 except that it is full cup and has no peripheral flange but rather comprises two inner double-sided tape strips 46 and 48 (FIG. 20) for releasably securing each SSBC 220 to a respective breast. In addition, the SSBC 220 contains a provision, e.g., a decorative lace band 50, for coupling two SSBCs 220 being worn, as shown in FIG. 18. The covering material 38 comprises a nude or black satin finish jersey Tricot or poly material for giving the SSBC 220 a natural skin-like texture. Furthermore, the covering material 38 is enhanced by a ½" decorative lace material 238 (e.g., a polyester lace) which surrounds the entire outer edge of the breast cup portion 22. The provision for coupling two SSBCs 220 together comprises respective bands of the ½" decorative lace material 238 that are joined (e.g., tied) together in the center, as shown in FIG. 18. The joining together of the decorative lace bands 50 is a style that appeals to a wearer with breasts that have a close separation. In the event that the tape strips 46 and 48 become detached from the wearer, the decorative lace bands 50 act as additional security in the attachment of the SSBCs 220 to the wearer. In addition, some women favor this style (with the decorative lace bands 50 joined) of the SSBCs 220 because from an outward appearance, it looks like a normal strapless brassiere but with the benefit of no back.

In particular, the SSBC 220 comprises two double-sided tape strips 46 and 48 that are disposed on the inside surface of the breast cup portion 22 of the SSBC 220 (FIG. 20). Each of the tape strips 46 and 48 comprise release sheets 52A/52B and 54A/54B, respectively. To releasably secure the SSBC 220 to the breast, the wearer repeats the application procedure discussed above with respect to the SSBC 20 (FIG. 2), except that there is no peripheral flange for securing against the skin surface above the lateral, medial and inferior portions of the wearer's rib cage.

It should be noted that unlike the Staykup™, the SSBCs 20, 120 and 220 are molded in pairs of breast cups with automatic precision from a pedal attached to a compressor. The operation takes approximately 5 seconds, molding a perfect cup to zero variance in tolerance for each pair. The lamination machine used in producing the SSBCs 20, 120 and 220 is specially designed with the appropriate temperature and time settings necessary to the produce the SSBCs 20, 120 and 220 described previously. The molding machine used for molding the SSBCs 20, 120 and 220 is pneumatically-controlled. The molding machine consists of two carriers, one for each half of the mold. One carrier is static whereas the other carrier moves vertically under pressure from an actuating cylinder, thereby enabling the molding action to occur. On the other hand, the Staykup™ was manufactured with hand or foot-operated presses 64 (FIG. 22) that produced breast cups of unequal shape or thickness. Furthermore, with the SSBCs 20, 120 and 220, special tools are needed to precision-cut the breast cups independently from the molded pair removed from the molding machine. The SSBCs 20, 120 and 220 are precisely the same from each precision cut. On the other hand, the Staykup™ was cut by hand, resulting in a non-perfect match from each cut.

Figure 23:
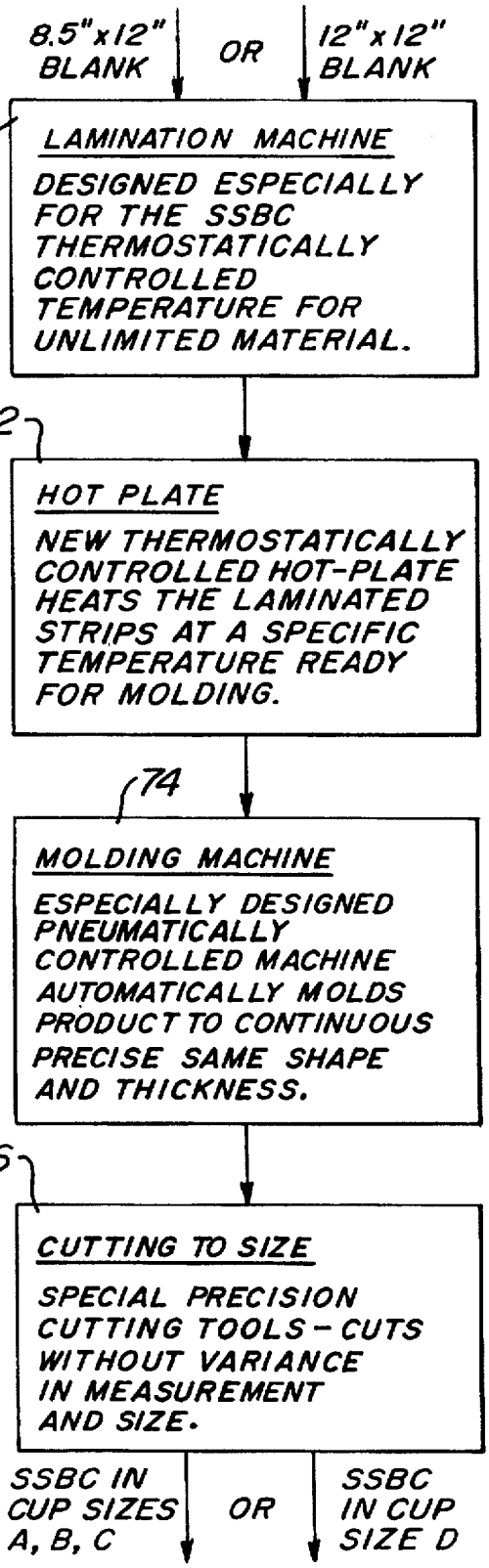
FIG. 23 is a block diagram of the manufacturing process of the present invention.

In particular, as shown in FIG. 23, the SSBCs 20, 120 and 220 are manufactured by first producing the lamination portion using the lamination machine 70. This lamination portion is then fed into a pneumatically-controlled hot plate 72 comprising two electrically heated plates, one of which is fixed to a cantilever lid. The plates are heated by means of a special mat element for providing total uniformity of heat distribution. Temperature of the plates is controlled by means of a built-in thermostat. Once the lamination portion is treated by the hot plate 72 for approximately 30 seconds, the material is inputted into a molding machine 74 for cold molding, wherein the material is pressed over breast molds. The output of the molding machine is a sheet with a plurality of these molded breast cups. Finally, the molded cups are then precision cut with the special tools 76 described above. The result of this process are the SSBCs 20, 120 and 220 comprising molded breast cups having a composition of Plastazote and satin tricot or polyester lace.

Figure 22:
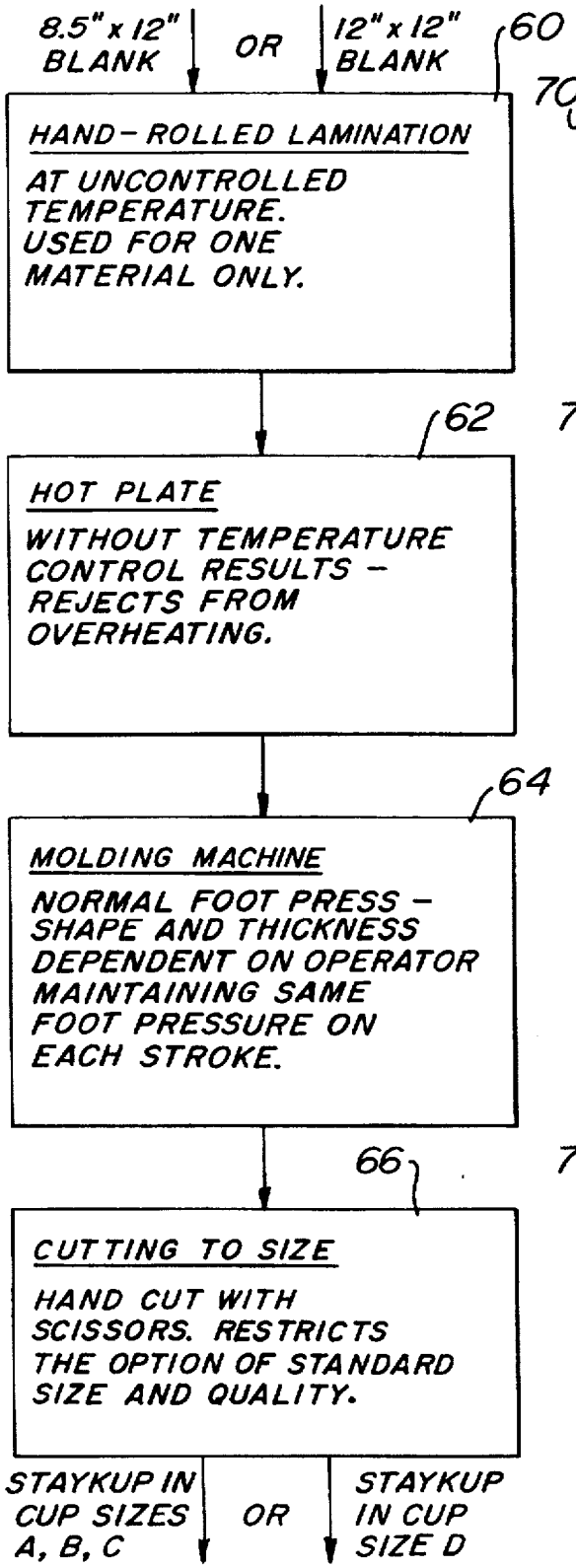
FIG. 22 PRIOR ART
FIG. 22 is block diagram of the manufacturing process of the prior art Staykup™.

This is in contradistinction to the Staykup™ manufacturing process shown in FIG. 22. In that process, the blanks are subjected to a hand-rolled lamination 60 at an uncontrolled temperature. The output is then fed to a hot plate 62 having no temperature control, which tends to create unacceptable output due to overheating. The output of the hot plate 62 is then inputted to a molding machine 64 that is controlled by a foot press; thus, the shape and thickness of the product is dependent upon the operator maintaining the same foot pressure on each stroke. Finally, the output of the molding machine 64 is hand-cut 66 with scissors which restricts the option of standard size and quality.

Thus, the Staykup™ (i.e., the prior art) manufacturing process (FIG. 22) is capable only of laminating and molding a synthetic, knitted, rough handle fabric because of the uncontrolled heat temperature. In contradistinction, because the manufacturing process of the SSBC 20, 120 and 220 (FIG. 23) is a specially-engineered process with controller temperatures, the range of materials for laminating and molding is extended to include new materials, such as fine jersey tricot and polyethylene satin or lace. These new materials enhance the finished product to a new elegance and glamour.

In summary, it should be understood that the Staykup™ cannot be readily converted into the SSBCs 20, 120 and 220. Neither the material nor the shape of the Staykup™ can be adapted into the soft shape, feel and presentation of the SSBCs 20, 120 and 220.

Without further elaboration, the foregoing will so fully illustrate our invention that others may, by applying current or future knowledge, readily adopt the same for use under various conditions of service.

We claim:

1. A reusable breast support apparatus comprising:

a soft cup portion adapted to receive a portion of the breast and wherein said soft cup portion is molded in the shape of the portion of the breast to support the breast and to provide a natural shape to the breast while covering the nipple;

a flattened peripheral flange portion extending about part of the periphery of the cup portion and being joined thereto at a fold line;

means for releasably securing said apparatus under the breast to the body independent of any coupling to other body parts, said releasable securing means forming a first adhesive layer on one side of said flattened peripheral flange portion, said first adhesive layer adhering to the body underneath the breast when said one side of said flattened peripheral flange portion is pressed against the body; and said apparatus comprising a satin jersey Tricot laminated to a low density closed cell cross-linked polyethylene foam.

2. The apparatus of claim 1 wherein said releasable securing means further comprises a second adhesive layer on an inside surface of said soft cup portion, said second adhesive layer adhering to the breast when said inside surface of said soft cup portion is pressed against the breast.

3. The apparatus of claim 2 wherein said first and second adhesive layers are adaptable for being coated with a renewer adhesive for permitting multiple wears of said apparatus.

4. The apparatus of claim 1 wherein said flattened peripheral portion comprises a first end and a second end, said first end extending away from said soft cup portion by a first predetermined distance and said second end extending away from said soft cup portion by a second predetermined distance.

5. The apparatus of claim 1 wherein said soft, cup receives ¾ of the breast including the nipple, thereby revealing the top part of the breast in wear.

6. The apparatus of claim 1 wherein said soft, cup receives the bottom half of the breast, including the nipple, thereby revealing the top half of the breast in wear.

7. A reusable breast support apparatus comprising:

a soft cup portion adapted to receive the full breast and wherein said soft cup portion is molded in the shape of a breast to support the breast and to provide a natural shape to the breast;

means for releasably securing said apparatus under the breast to the body independent of any coupling to other body parts, said releasable securing means forming a pair of adhesive layers on an inside surface of said soft cup portion, said adhesive layers adhering to the breast when said inside surface of said soft cup portion is pressed against the breast: and said apparatus comprising a satin polyester laminated to a low density closed cell, cross-linked polyethylene foam.

8. A reusable breast support apparatus comprising:

a soft cup portion adapted to receive a portion of the breast and wherein said soft cup portion is molded in the shape of the portion of the breast to support the breast and to provide a natural shape to the breast while covering the nipple;

a flattened peripheral flange portion extending about part of the periphery of the cup portion and being joined thereto at a fold line;

means for releasably securing said apparatus under the breast to the body independent of any coupling to other body parts, said releasable securing means forming a first adhesive layer on one side of said flattened peripheral flange portion, said first adhesive layer adhering to the body underneath the breast when said one side of said flattened peripheral flange portion is pressed against the body; and said apparatus comprising a polyester lace laminated to a low density closed cell, cross-linked polyethylene foam.

9. A reusable breast support apparatus comprising:

a soft cup portion adapted to receive the full breast and wherein said soft cup portion is molded in the shape of a breast to support the breast and to provide a natural shape to the breast;

means for releasably securing said apparatus under the breast to the body independent of any coupling to other body parts, said releasable securing means forming a pair of adhesive layers on an inside surface of said soft cup portion, said adhesive layers adhering to the breast when said inside surface of said soft cup portion is pressed against the breast; and said apparatus comprising a satin jersey laminated to a low density closed cell, cross-linked polyethylene foam.

10. A reusable breast support apparatus comprising:

a soft cup portion adapted to receive the full breast and wherein said soft cup portion is molded in the shape of a breast to support the breast and to provide a natural shape to the breast;

means for releasably securing said apparatus under the breast to the body independent of any coupling to other body parts, said releasable securing means forming a pair of adhesive layers on an inside surface of said soft cup portion, said adhesive layers adhering to the breast when said inside surface of said soft cup portion is pressed against the breast; and said apparatus comprising a polyester lace laminated to a low density closed cell, cross-linked polyethylene foam.

11. The apparatus of claim 10 further comprising a decorative lace band that is coupled to said soft cup portion, said decorative lace band being adaptable for connecting to a second breast support apparatus having its own decorative lace band.

* * * * *